US012098895B1

(12) United States Patent
Istvanovics

(10) Patent No.: US 12,098,895 B1
(45) Date of Patent: Sep. 24, 2024

(54) DEVICE FOR CONVERTING A SEMI-AUTOMATIC SELF-LOADING GUN TO A FULL AUTOMATIC WEAPON

(71) Applicant: ATLAS GROUP INTERNATIONAL ZRT., Budapest (HU)

(72) Inventor: Mihaly Istvanovics, Budapest (HU)

( * ) Notice: Subject to any disclaimer, the term of this patent is extended or adjusted under 35 U.S.C. 154(b) by 0 days.

(21) Appl. No.: 18/028,666

(22) PCT Filed: Nov. 3, 2020

(86) PCT No.: PCT/HU2020/050050
§ 371 (c)(1),
(2) Date: Mar. 27, 2023

(87) PCT Pub. No.: WO2022/079456
PCT Pub. Date: Apr. 21, 2022

(30) Foreign Application Priority Data

Oct. 15, 2020 (HU) ..... P2000341

(51) Int. Cl.
*F41A 19/09* (2006.01)
*F41A 5/02* (2006.01)

(52) U.S. Cl.
CPC ..... *F41A 19/09* (2013.01); *F41A 5/02* (2013.01)

(58) Field of Classification Search
CPC .. F41A 19/09; F41A 5/02; F41A 19/33; F41A 19/58; F41A 19/46
USPC ..... 42/72, 71.01, 71.02, 73
See application file for complete search history.

(56) References Cited

U.S. PATENT DOCUMENTS

| | | | | |
|---|---|---|---|---|
| 6,543,173 | B1 * | 4/2003 | Golan | F41C 9/00 89/14.05 |
| 7,437,847 | B1 * | 10/2008 | Mabry | F41C 23/04 42/73 |
| 7,552,557 | B1 * | 6/2009 | Mabry | F41A 11/04 42/71.01 |
| 9,441,898 | B2 * | 9/2016 | Istvánovics | F41A 19/09 |
| 10,627,189 | B2 * | 4/2020 | Faifer | F41C 33/001 |
| 10,801,800 | B1 * | 10/2020 | Chia | F41C 23/16 |
| 2011/0088305 | A1 * | 4/2011 | Oz | F41C 23/12 42/69.01 |
| 2012/0131829 | A1 * | 5/2012 | Fistikchi | F41C 23/22 42/1.06 |
| 2013/0185975 | A1 * | 7/2013 | Johnson | F41A 19/08 29/401.1 |
| 2015/0241154 | A1 * | 8/2015 | Istvanovics | F41A 19/09 89/140 |

(Continued)

*Primary Examiner* — Joshua E Freeman

(57) ABSTRACT

An improved device for converting a semi-automatic self-loading handgun into a fully automatic weapon. The handgun is fixed in the front part of a case. An operating trigger is arranged in the case behind the handgun. Between the operating trigger and the trigger of the handgun a means is provided that causes pulling the trigger in a repeated series as long as the operating trigger is pulled. A hitting element is locked when being in rear position and when the operating trigger is in non-pulled state. A rocking arm causes the pulling of the own trigger when the hitting element is forced by a spring to move forward in the pulled state of the operating trigger. A locking assembly is provided and prevents forward movement of the hitting element, this locking starts when the slide has moved into rearmost position until the slide returns into its forward base position.

6 Claims, 12 Drawing Sheets

(56) References Cited

U.S. PATENT DOCUMENTS

2016/0025438 A1* 1/2016 Alderman ..... F41A 19/09
42/70.11

* cited by examiner

DEVICE FOR CONVERTING A SEMI-AUTOMATIC SELF-LOADING GUN TO A FULL AUTOMATIC WEAPON

The invention relates to an improved device for converting a semi-automatic self-loading handgun to a full automatic weapon, in which the handgun comprises a slide and an own trigger, and the handgun is fixed and placed in a front part of a case.

State of the art handguns are generally self-loading and semi-automatic, in which by the subsequent pulling of the trigger respective shots can be delivered. Owing to the displacement effect of reaction forces delivered by a shot that act on the hand, handguns are generally not designed as full-automatic arms, because for targeting it is required that the hand holding the gun can be used for targeting prior to the shot.

In many case the use of full-automatic arms can be justifiable, but only then if an appropriate support of the gun can be provided during the series of shots.

Even because of the justifiable nature of serial shots and of the high costs of full-automatic weapons there is an objective need of using generally available and cheap handguns for serial shooting.

The publication WO2014/041382 A2 relates to such a device in which the handgun comprises a slide and an own trigger and it is fixed in the front part of a case, and in the portion of the case behind the handgun and operating trigger is provided, and between the operating trigger and the own trigger of the handgun a means is provided that pulls the own trigger in a repeating series as long as the operating trigger is kept pulled. The design of the case with the handgun arranged therein is similar to that of an automatic self loading weapon.

Although the referred design can be regarded as a serious step forward with respect to previous solutions the mechanical solution had certain drawbacks.

Of the drawbacks it can be mentioned that in case of series shots when the user keeps the operating trigger in pulled position, then the hitting element is not locked in its rearmost position and under the effect of the spring bias it moves again in forward direction and causes the next pulling of the own trigger of the handgun. This pulling can result a shot only if by the time the own trigger gets pulled the slide of the handgun has returned its forward position and a new cartridge has been loaded. Because in the referred solution these processes take place in parallel and independent from each other nothing guarantees that the own trigger can be pulled again when the handgun has returned to its base position when it is ready for the next shot. From this it may happen the serial shot are not always successful and the process stops and the operation is not safe.

A further problem lies in that during firing the slide of the handgun moves in backward direction and this motion moves the hitting element against the biasing force of a spring also backwards, and in the rear position the hitting element is withheld together with the so tensioned spring by a lock. During that time the slide is moved forward by a spring tensioned also under the effect of the previous rearward motion of the slide. The new shot is triggered by the release of the previously biased spring because the front end of the hitting element pushed forward by the previously biased spring will cause the pulling of the own trigger of the handgun through an appropriate mechanical coupling. Such a design is less preferred because the rearward motion of the slide of the handgun has to bias two springs which in certain case might represent a too high load for the slide. In case the rearward directed pushing force is exposed to double load, then during use of a cartridge with smaller firing force it might not be safe that the hitting element can arrive into the position required to the locking, which is otherwise an indispensible condition of the correct functioning. It would be more preferred if the force available for the backward movement of the slide would be made independent from the bias required for moving the hitting element forward.

Because of these drawbacks the referred known device is less appropriate for delivering shots in series.

The object of the invention is the improvement of this known device in such a way that can always guarantee the reliable operation.

According to the invention a device has been provided for converting a semi-automatic self-loading handgun into a full automatic weapon, wherein the handgun comprises a slide and an own trigger, and the handgun is fixed in a front part of a case, an operating trigger is arranged at a part of the case behind the handgun, and between the operating trigger and the own trigger of the handgun a means is provided that causes pulling the own trigger in a repeated series when the operating trigger is in pulled state, this means comprises a hitting element which is locked by a first locking assembly when being in rear position and when the operating trigger is in its base i.e. non-pulled state, and a rocking arm is provided on the handgun which pulls the own trigger by the forward state of the hitting element when the hitting element is forced by a spring to move forward after being released from the previous locked state, wherein according to the invention the device comprises a second locking assembly that prevents forward movement of the hitting element, wherein the second locking starts when the slide has moved into its rearmost position and lasts as long as the slide returns into its forward base position when the firing with the handgun is safely possible.

By such a design it has been ensured that in case of firing a series of shots the second (and all further) shots can take place only when the handgun has returned to a loaded and ready to shot state.

In a preferred embodiment the second locking assembly comprises a cut provided at the bottom of one side of the hitting element that inclines in upward and rear direction and has a sudden steep end, and a delaying rock lever that snaps into the cut in the rear position of the hitting element and locks thereby its forward movement, and a control rod is coupled to the delaying rock lever that extends along the length of the handgun in forward direction and has a front part that crosses the front face of the slide when it returns to its base state and causes then release of the second locking.

It is preferred if the delaying rock lever comprises a rearward extending upper arm and a downwardly extending lower arm which arms close an angle with each other, and between the arms a pivot shaft is arranged that holds the delaying rock lever, and a spring is provided that presses the upper arm to the direction of the cut, and the lower arm is coupled by a pivot shaft to the rear end part of the control rod.

The bias required for moving t hitting element forward can be made independent from the rearward motion of the slide if the device comprises a spring-biasing member arranged on the handgun in front of the hitting element and the spring-biasing member has a front part bent down to extend in front the front face of the slide, and also comprises a spring that interconnects the hitting element with the spring-biasing member, and when the slide is moved backwards both the spring-biasing member and the hitting element move together backward but when the slide moves forward and the hitting element is locked, the spring-biasing member moves forward with the slide and causes the spring to expand, and when the locking of the hitting element is released the bias of the spring causes the hitting element to move forward and to cause a shot.

It is preferred if the hitting element has a bottom having two separate steps behind each other, wherein the height of the forward step corresponds to the height of an upper shaft provided on the rocking arm that crosses the path of the first step, and the bottom of the hitting element behind the first step is fitted to the upper surface of the slide and slides thereon, and the second step is behind the rear end of the slide, and the slide can move the hitting element backward by the impact between the rear face and the second step.

It is preferred if the second locking assembly is arranged slightly more rearward than the first locking assembly in order that after release of the second locking the first locking assembly can still lock the forward movement of the hitting element.

The invention will now be described in connection with preferable embodiments thereof, in which reference will be made to the accompanying drawings. In the drawing.

Figure 3:
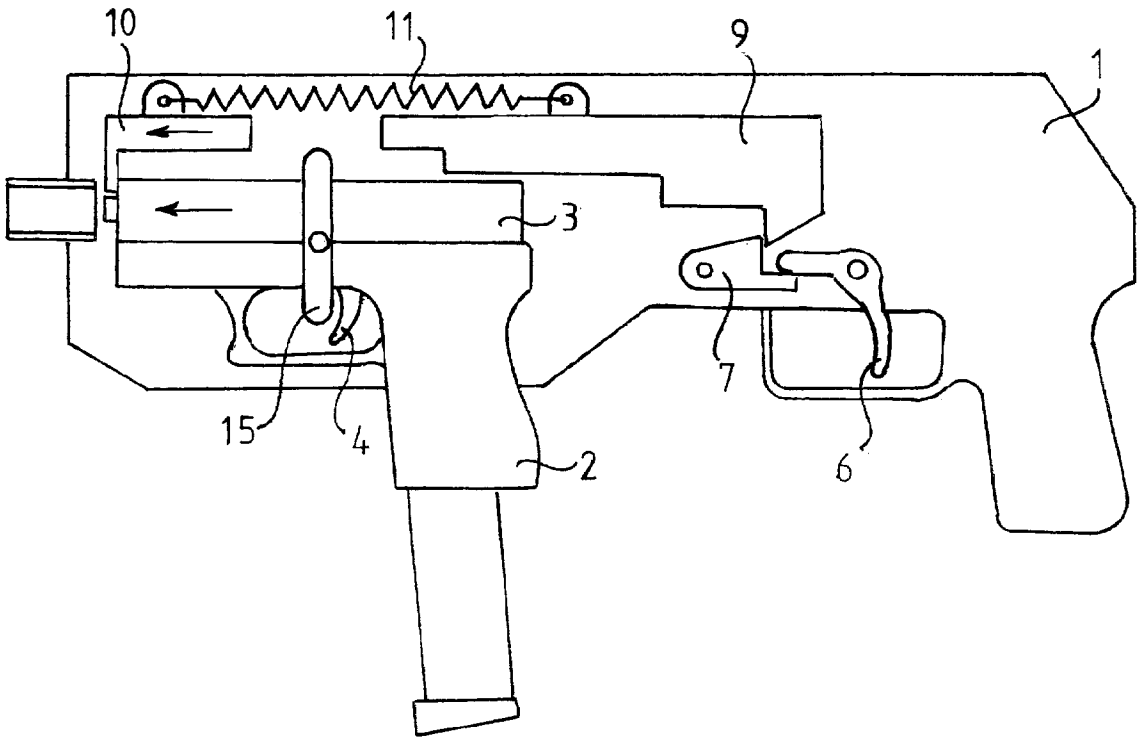
FIG. 3 is a sketch similar to that of FIG. 2, wherein the slide 3 is again in its base position but the hitting element 9 has remained locked in the rear position.
Figure 4:
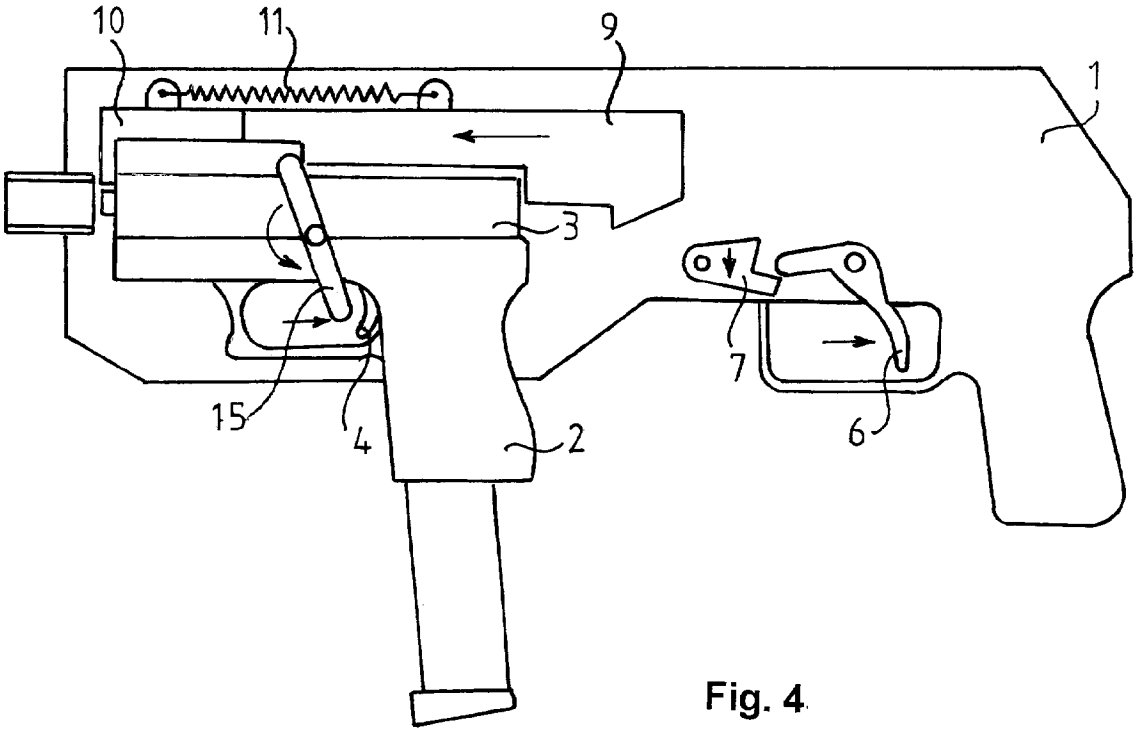
Figure 5:
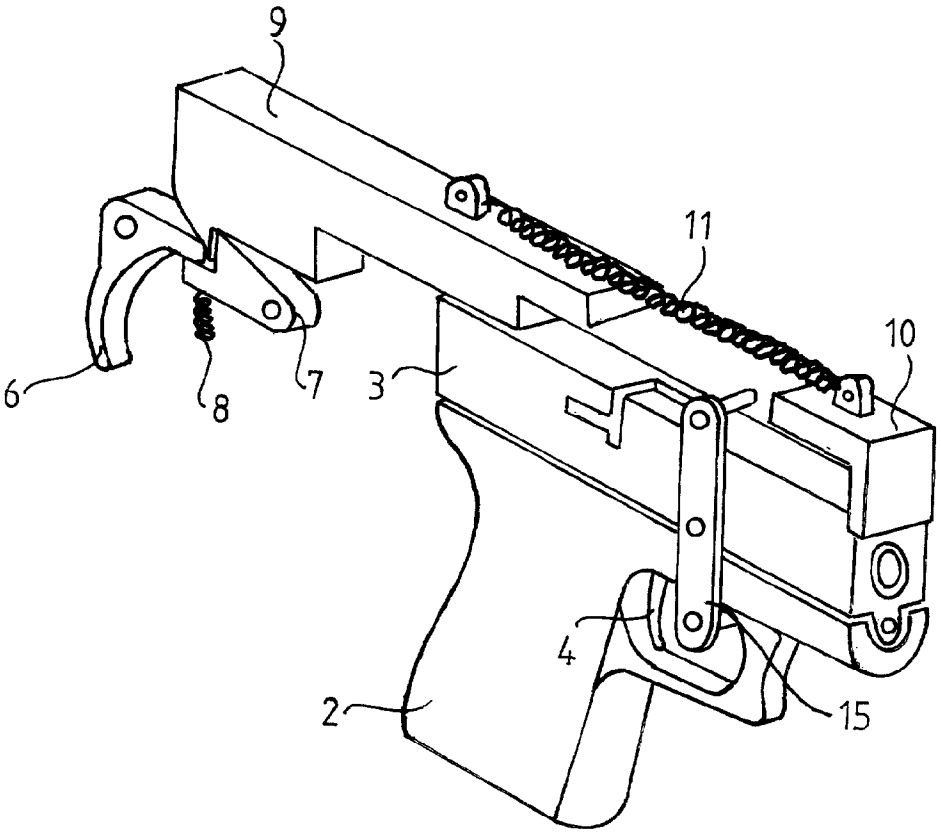
Figure 6:
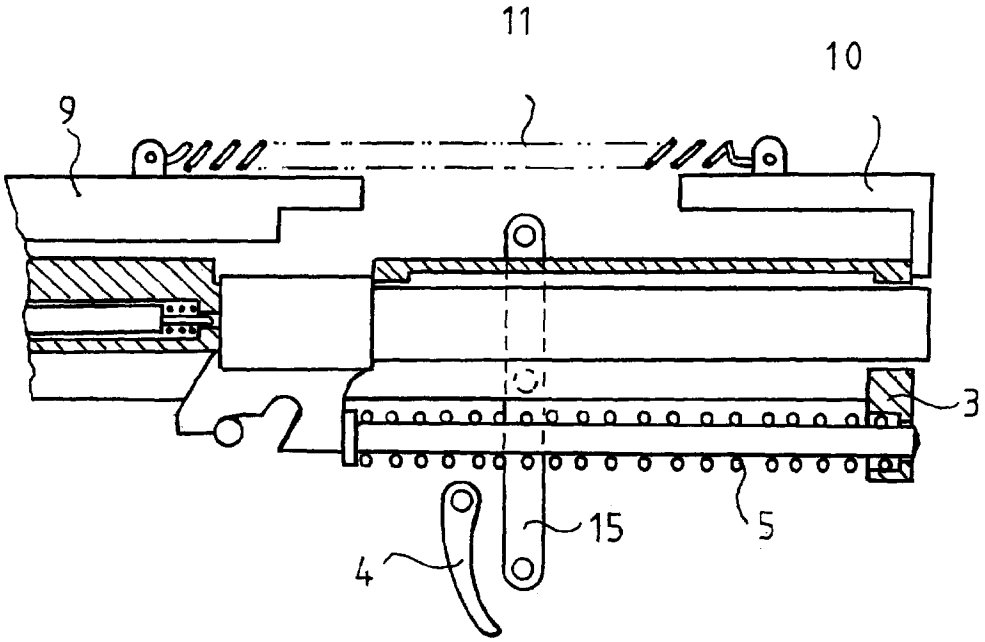
Figure 7:
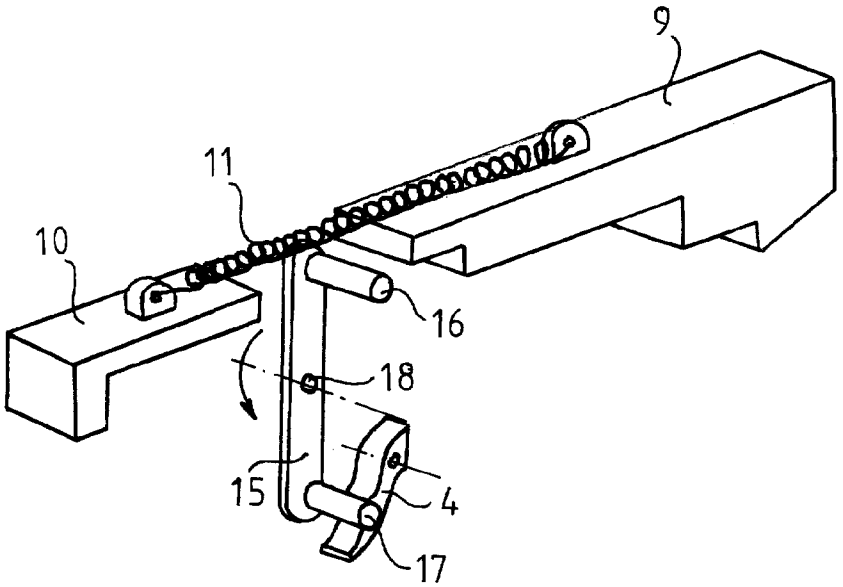
Figure 8:
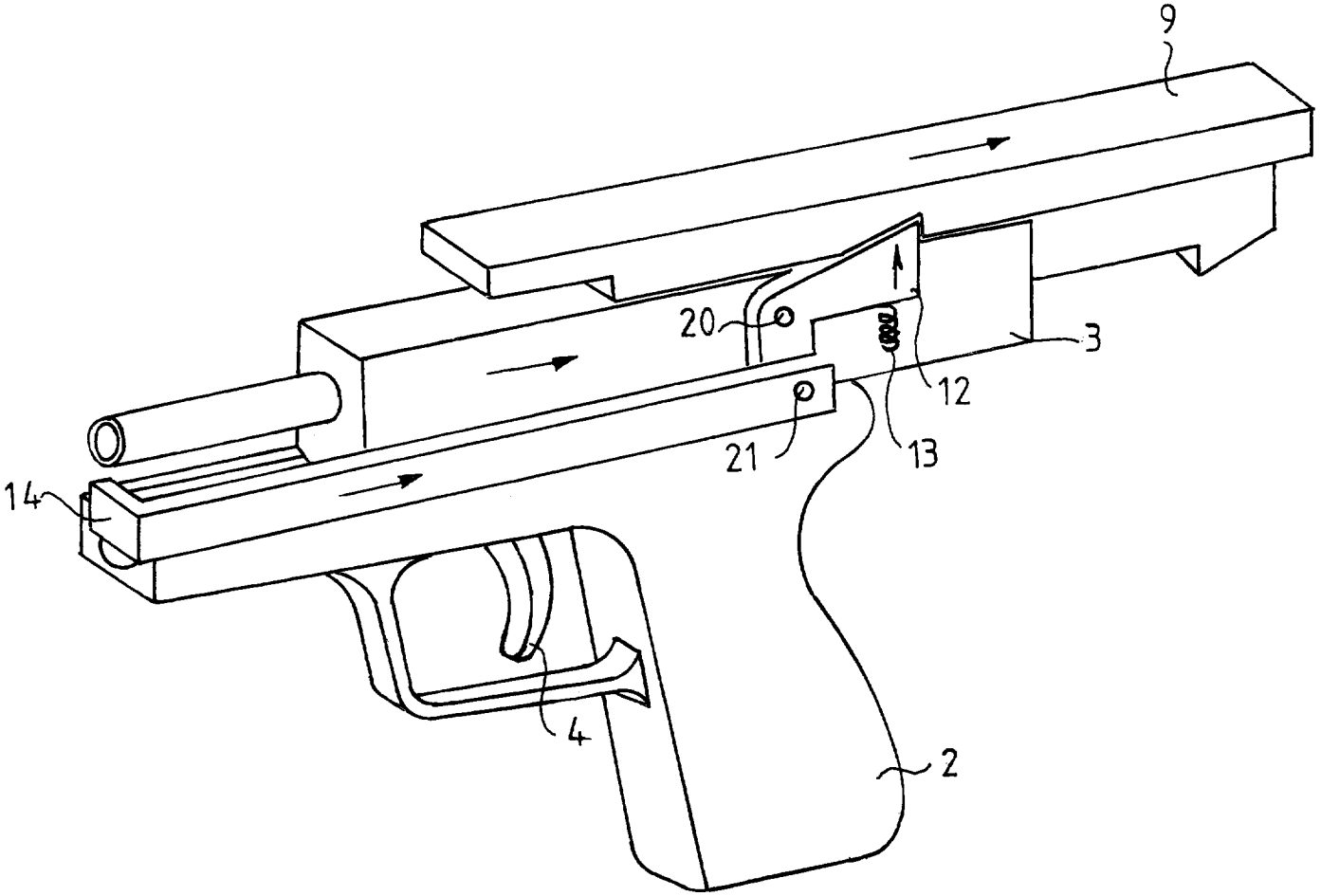
Figure 9:
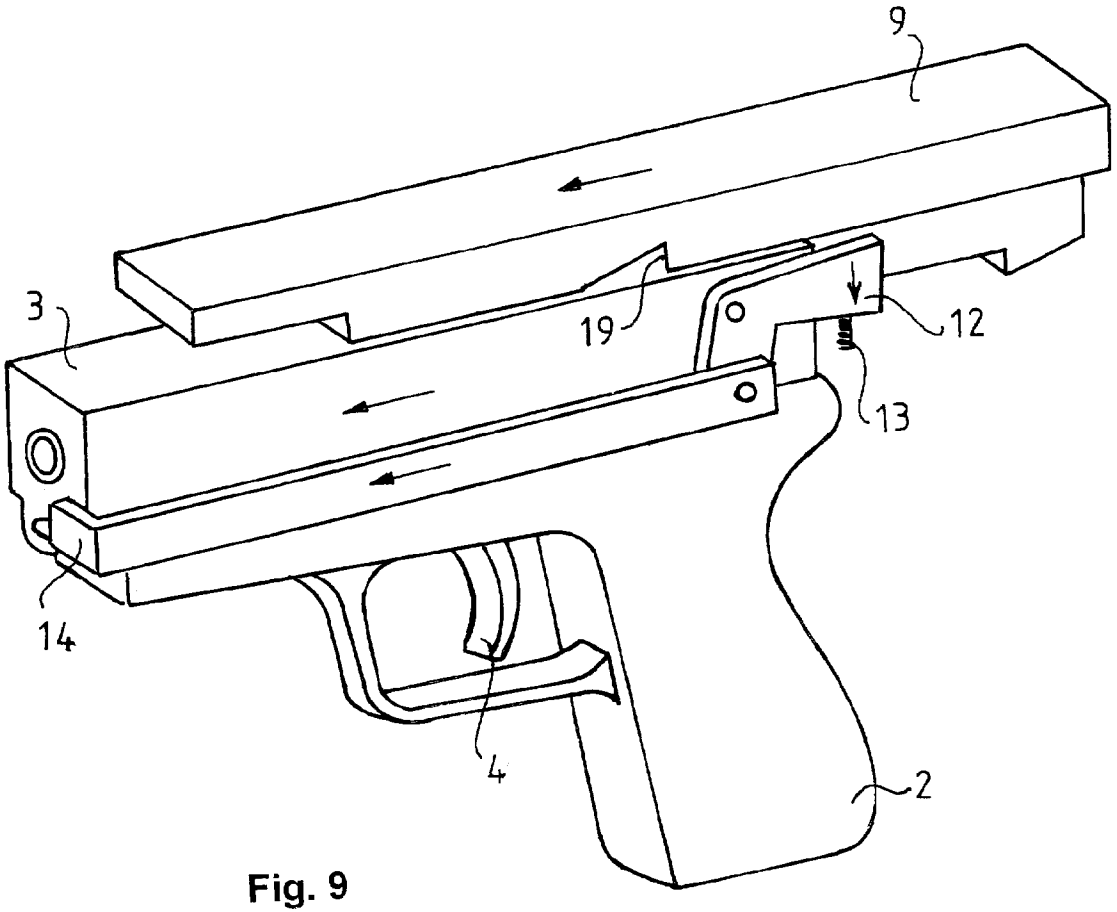
Figure 10:
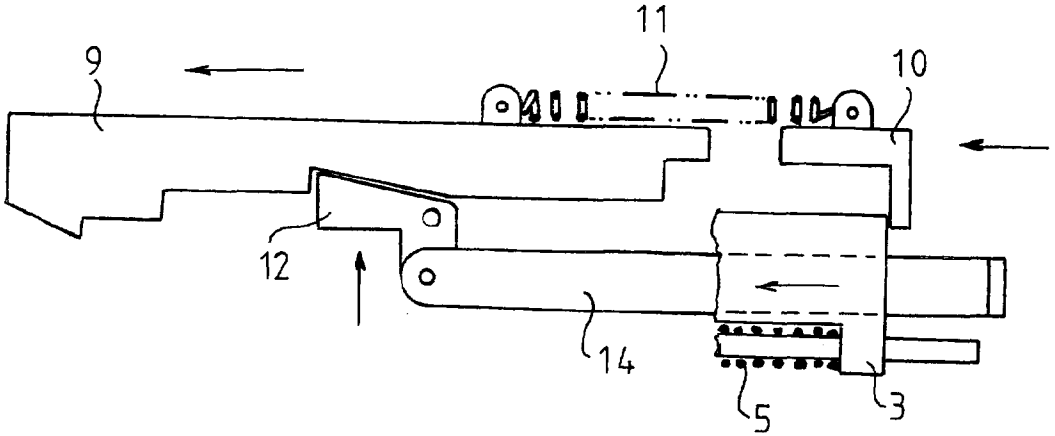
Figure 11:
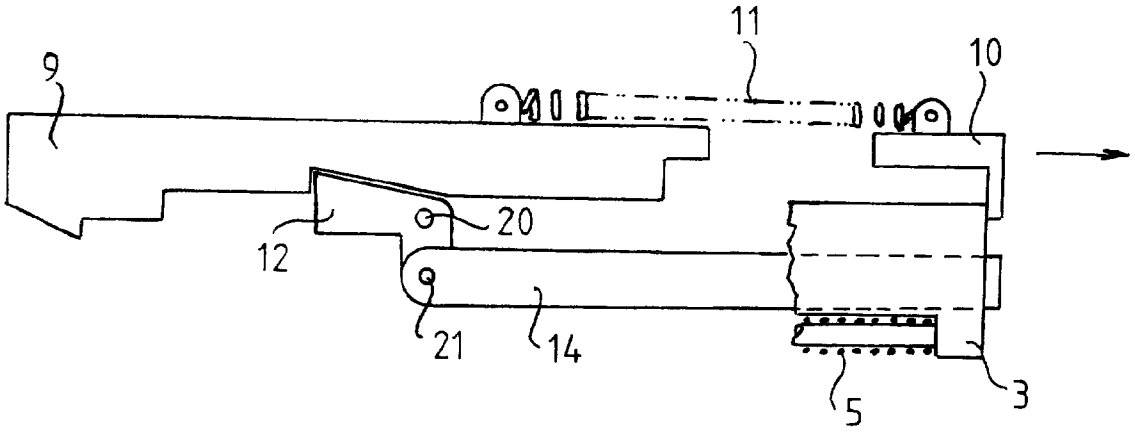
Figure 12:
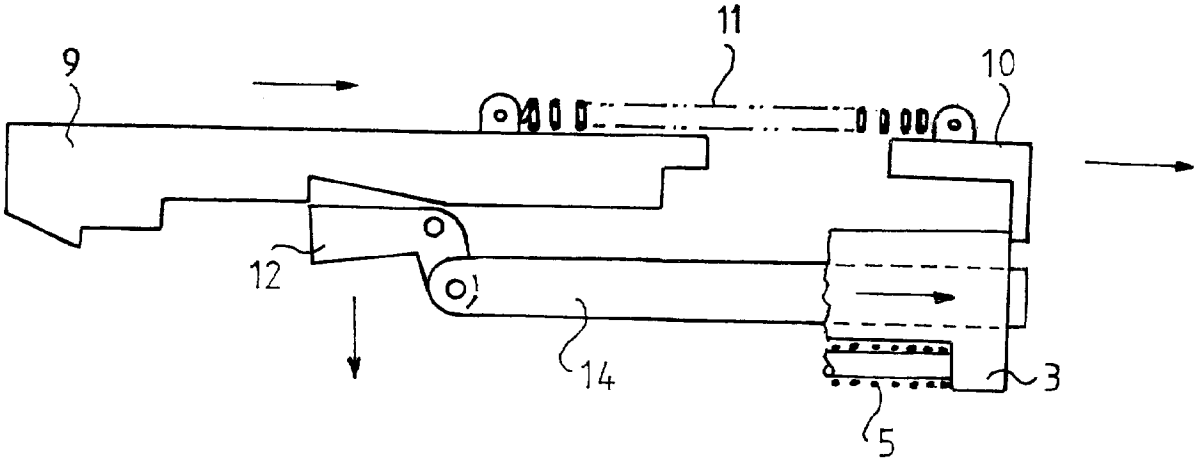

FIG. 4 a sketch similar to that of FIG. 3, wherein the hitting element 9 moves forward to deliver a shot;

FIG. 5 is a perspective view in a position before the delivery of a shot;

FIG. 6 shows an enlarged detail in sectional view;

FIG. 7 shows a detail illustrating the movement of the own trigger 4;

FIG. 8 shows a perspective view illustrating a further aspect of the invention when the hitting element 9 is in its second type locking;

FIG. 9 is a perspective view similar to that of FIG. 8 in a phase following the locking has been released;

FIG. 10 sows a detail of the delay assembly in the initial phase of the locking;

FIG. 11 is a detail similar to FIG. 10 at the beginning of the release of the locking; and FIG. 12 is a further detail similar to FIG. 10 at the end of releasing the locking.

Figure 1:
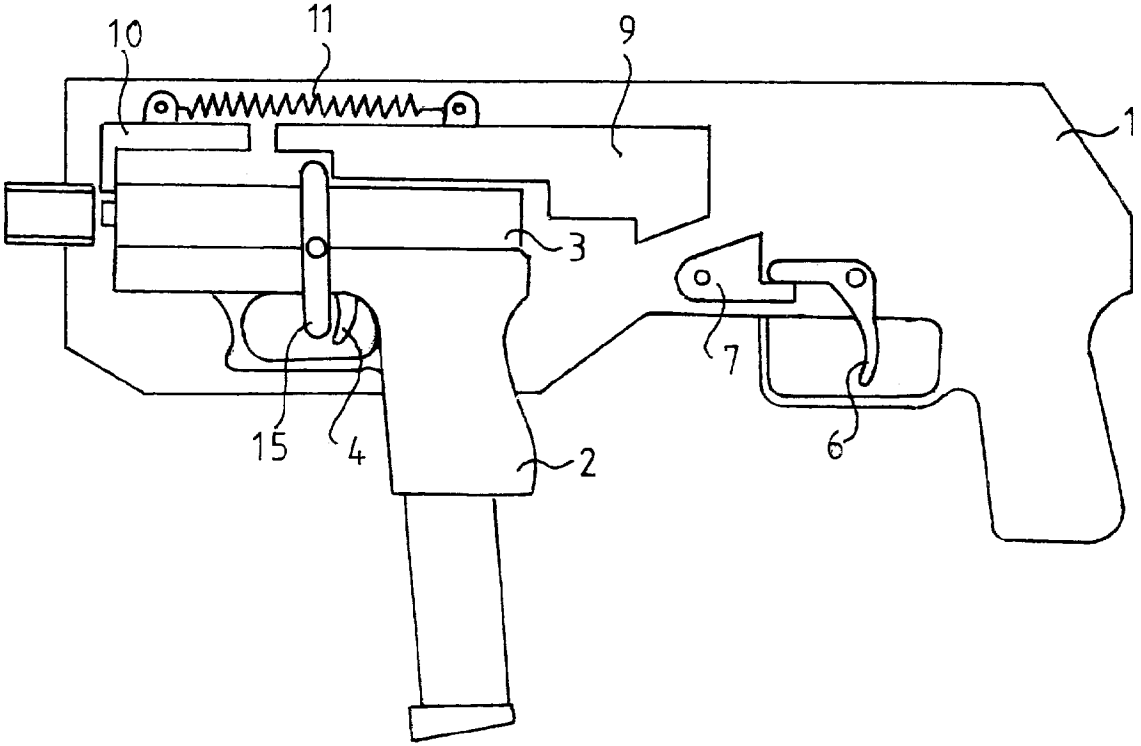
FIG. 1 shows the schematic view of the device according to the invention in starting position.

In FIG. 1 the device according to the invention has been sown in its base state in which a handgun 2 is positioned in a case 1 as shown in the drawing. It is noted that a structure not shown in the drawing ensures that the handgun 2 can be placed in the case 1 only in unloaded state.

The design of the case 1 corresponds to that of a conventional semi-automatic self loading gun which can be learned from the previously referred publication WO2014/041382A2 that comprises a shooting trigger 6 operated by the user.

The handgun 2 has a usual design and from the point of view of the present invention it is important that the handgun 2 has a slide 3 that can move in forward-backward direction relative to the body of the handgun 2. In FIG. 1 the slide 3 is in its most forward base position. For the operation the slide 3 has to be pulled by the user in backward direction till abutment against the force of a biasing spring (not shown in FIG. 1). Under the effect of such a movement from the own magazine a cartridge will get automatically loaded. The slide 3 is coupled with a spring-biasing member 10 and behind this latter a hitting element 9 is provided and guided for longitudinal displacement, and the hitting element 9 has a height that increases in a stepwise manner in backward direction as shown in FIG. 1. Upper parts of the hitting member 9 and the spring-biasing member 10 are interconnected by spring 11. The perspective view of the listed components can be seen in FIG. 7.

Figure 2:
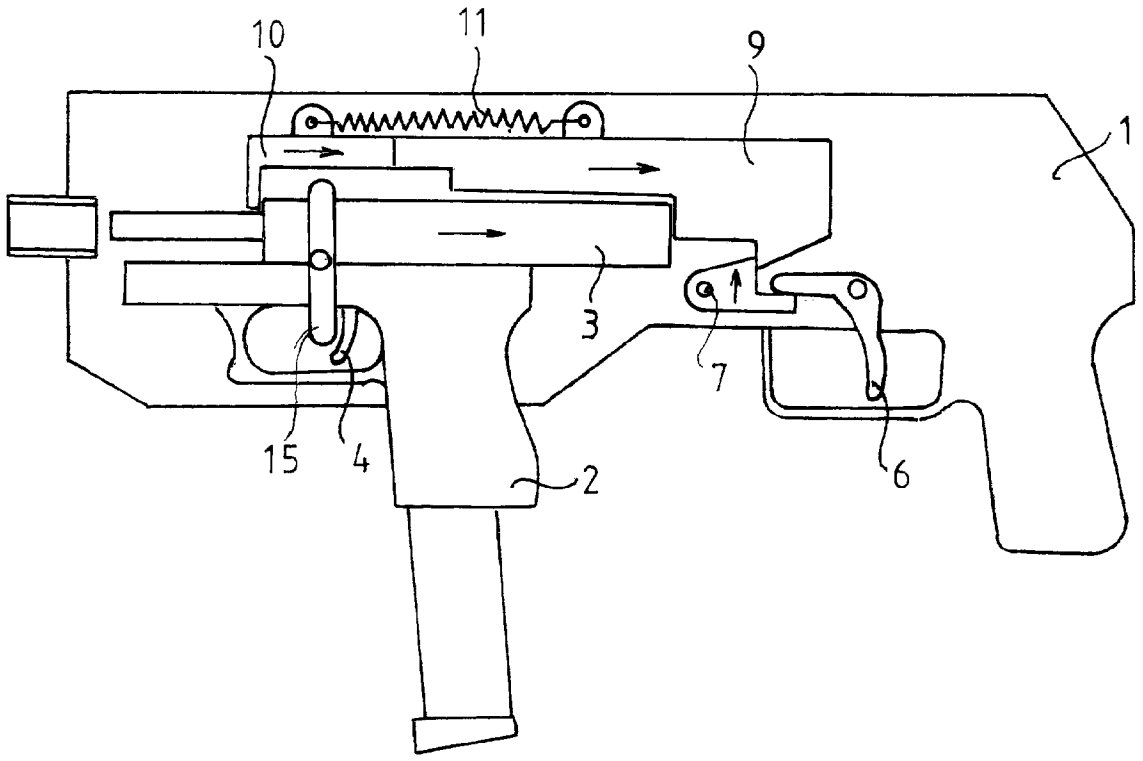
FIG. 2 is a sketch similar to that of FIG. 1, wherein the slide 3 is in its pulled rearward position.

For the operation of the gun first the slide 3 has to be pulled back, as mentioned above. The pulled state is shown in FIG. 2 in which respective arrows show the direction of the displacement. The rearward movement of the slide 3 is followed by the spring-biasing member 10 and the hitting element 9 so that they are abutting to each other, wherein the lowest step of the hitting element 9 is pushed by the rear face of the slide 3, and the spring biasing member 10 is moved backwards by the spring 11 without being biased. At the rear lower part of the hitting element 9 a further downward step is provided which forms a lock with upper part of a rock lever 7. This detail of the device can be observed also in the perspective view of FIG. 5. The fulcrum of the rock lever 7 is in the front part of the rock lever 7 and it has a rear part pushed upward by spring 8. The rock lever 7 has an inclined upper surface which is pushed downward by the bottom of the backwardly moving hitting element 9 against the biasing force of the spring 8, and when the hitting element 9 reaches the rear position shown in FIG. 5 then owing to the jump in the bottom of the hitting element 9, the rock lever 7 springs suddenly in upward direction and locks thereby the position of the hitting element 9 and keeps it in this rear position.

When the slide 3 is released, an inner spring 5 (that can be seen in FIG. 6) moves the slide 3 quickly forward which is illustrated in FIG. 3. The spring-biasing member 10 has a downwardly projecting forward face that abuts the forward face of the slide 3 therefore the spring-biasing member 10 follows the movement of the slide 3. Because the hitting element 9 is kept in the previously mentioned locked rear position, the spring 11 will extend and becomes biased. It is noted that the biasing of the spring 11 is made by the return movement of the slide 3 to its base state under the force of the inner spring 5 and not by the rearward motion of the slide 3 which is a substantial difference compared with the previously referred known solution, because this expansion does not represent a substantial load for the inner spring 5 of the handgun 2. The return movement of the slide 3 ensures also the loading of a new cartridge in a known way, whereby in the position shown in FIG. 3 the arm will be ready for shooting.

For firing a shot the shooting trigger 6 of the case 1 should be pulled. This state is shown in FIG. 4. As a result of the pulling of the shooting trigger 6 this will turn around its own shaft, and its forward arm which was pushed previously to the forward lower surface of the rock lever 7 will be pushed and moved in downward direction that will release to locking of the hitting element 9 which will now be pulled forward by the biased spring 11. An intermediate position of this forward movement is shown in the enlarged detail of FIG. 6, in which we can see the slide 3 with the gun's tube therein, the spring-biasing member 10 caught at the front end of the slide 3 and the remotely positioned hitting element 9 with its inner steps. The handgun 2 has an own trigger 4 also being spring-biased, and in from of the own trigger 4 a rocking arm 15 is arranged that is designed as a double-armed lever, the parts of which are illustrated in the perspective sketch view of FIG. 7. The rocking arm 15 has an upper shaft 16 extending normal to the direction of movement of the slide 3, a pivot axis 18 in the middle and at its lower end a lower shaft 17. The upper shaft 16 is arranged in the height of the upper step of the hitting element 9 so that it crosses the path thereof. The lower shaft 17 is arranged immediately in front of the own trigger 4. When the hitting element 9 moves forward with high speed under the pulling force of the spring 11, the forward face of its upper step will hit the upper shaft 16 and pushes it firmly in forward direction. Under this effect the rocking arm 18 will turn around its pivot axis 18 and the lower shaft 17 moves the own trigger 4 in backward direction towards the grip of the handgun 2 which triggers a shot in a know way.

As a result of the shot the bullet will fly forward and the counter forces of the outwardly streaming gases push the slide 3 backwards and then the hitting element 9 and the spring-biasing member 10 with it will move also in backward direction as described earlier.

In the present structural design a first substantial difference compared to the previously referred known solution lies in the way of movement of the hitting element 9, because the spring 11 will be biased by the returning forward motion of the slide 3 and not by the backward movement coming from the reaction forces of the departing gases.

A further essential or possibly more essential aspect will be described in connection with FIGS. 8 to 12. In the perspective view of FIG. 9 it can be seen that at one side of the hitting element 9 there is a wedge like cut 19 which inclines at a considerable length in backward and upward direction then it ends suddenly by a vertical wall normal to the direction of movement. In FIG. 8 both the slide 3 and the hitting element 9 are at the rearmost position of their respective paths or very close to it. At the same side of the handgun 2 a delaying rock lever 12 and a control rod 14 can be seen, wherein the control rod 14 has the task of moving the rock lever 12. The delaying rock lever 12 can be turned around a pivot shaft 20 and has a lower arm which is pivotally connected to the rear end of the control rod 14 by means of shaft 21. The rear arm of the delaying rock lever 12 is pressed in upward direction by spring 13.

In the rear position shown in FIG. 8 the nose part of the rear arm of the delaying rock lever 12 is in opposite position with the rear face of the cut 19 and the spring 13 presses this nose part into the cut 19 which prevents any forward movement of the hitting element 9.

In FIGS. 10 to 12 the respective phases of the so realized delayed locking are shown. FIG. 10 shows the position when following a shot the slide 3 has moved into its rearmost position and the rear arm of the delaying rock lever 12 was pushed upward by the spring bias and fitted into the cut 19 of the hitting element 9. At the same time the slide 3 is in rear position and there is a great distance between its forward end and the forward end of the control rod 14 which is bent inward, and the spring 11 is not yet biased.

In FIG. 11 the delaying rock lever 12 is still in locked position but the inner spring 5 of the handgun 2 has almost pushed the slide 3 to its original (forward) position, the spring 11 is already under tension and the front face of the slide 3 has just touches the bent front end of the control rod 14. Then, when the slide 3 moves further forward, its movement will be followed by the control rod 14 and its rear end will cause the rear arm of the delay rock lever 12 through the pivotal shafts 21 and 20 to move downward which releases the locking.

FIG. 12 shows the position when the slide 3 has returned to the initial base position and the delaying rock lever 12 cannot prevent any further the forward movement of the hitting element 9 which is indicated by the forwardly pointed arrows. The handgun 2 is ready for a repeated shot.

Now events will take place that depend on the intention of the user. If the user does not want that further shots follow the previous one, then he will not keep the shooting trigger 6 pulled, and then the rock lever 7 will lock the hitting element 9, and for the next shot the shooting trigger 6 should be pulled.

In case the user wishes to deliver a series of shots, he keeps the shooting trigger pulled and therefore the rock lever 7 remains in unlocked position and by the release of the locking caused by the delaying rock lever 12 nothing will prevent the forward movement of the hitting element 9 and as described earlier a safe shot will be triggered by the operating of the own trigger 4.

The essence of the solution described here lies in that the second locking lasts only as long as following a shot the slide 3 returns again to the initial forward position when the repeated loading of the handgun 2 has been completed and it Is again ready for the next shot. In this way for reaching the next "ready for shot" state the described assembly provides the required delay. This delay lasts for a very short time but its presence will prevent any premature pulling of the own trigger 4 which could not result in any actual shot but could disturb normal functioning.

The solution according to the invention guarantees a safe use of the handgun 2 by providing the required delay, which has an outstanding significance.

The invention claimed is:

1. A device for converting a semi-automatic self-loading handgun into a full automatic weapon, wherein the handgun (2) comprises a slide (3) and an own trigger (4), and the handgun (2) is fixed in a front part of a case (1), an operating trigger (6) is arranged at a part of the case (1) behind the handgun (2), and between the operating trigger (6) and the own trigger (4) of the handgun a means is provided that causes pulling the own trigger (4) in a repeated series when the operating trigger (6) is in pulled state, said means comprises a hitting element (9) which is locked by a first locking assembly when being in rear position and when the operating trigger (6) is in its base i.e. non-pulled state, and a rocking arm (15) is provided on the handgun (2) which pulls the own trigger (4) by the forward state of the hitting element (9) when the hitting element (9) is forced by a spring to move forward after being released from the previous locked state, characterized by comprising a second locking assembly that prevents forward movement of the hitting element (9), wherein said second locking starts when the slide (3) has moved into its rearmost position and lasts as long as the slide (3) returns into its forward base position when the firing with the handgun is safely possible.

2. The device as claimed in claim 1, characterized in that the second locking assembly comprises a cut (19) provided at the bottom of one side of the hitting element (9) that inclines in upward and rear direction and has a sudden steep end, and a delaying rock lever (12) that snaps into the cut (19) in the rear position of the hitting element (9) and locks thereby its forward movement, and a control rod (14) coupled to the delaying rock lever (12) that extends along the length of the handgun (2) in forward direction and has a front part that crosses the front face of the slide (3) when it returns to its base state and causes then release of the second locking.

3. The device as claimed in claim 2, characterized in that the delaying rock lever (12) comprises a rearward extending upper arm and a downwardly extending lower arm which arms close an angle with each other, and between the arms a pivot shaft (20) is arranged that holds the delaying rock lever (12), and a spring (13) is provided that presses the upper arm to the direction of the cut (19), and the lower arm is coupled by a pivot shaft (21) to the rear end part of the control rod (14).

4. The device as claimed in claim 1, characterized by comprising a spring-biasing member (10) arranged on the handgun (2) in front of the hitting element (9) and the spring-biasing member (10) has a front part bent down to extend in front the front face of the slide (3), and a spring (11) that interconnects the hitting element (9) with the spring-biasing member (10), and when the slide (3) is moved backwards both the spring-biasing member (10) and the hitting element (9) move together backward but when the slide (3) moves forward and the hitting element (9) is locked, the spring-biasing member (10) moves forward with the slide (3) and causes the spring (11) to expand, and when the locking of the hitting element (9) is released the bias of the spring (11) causes the hitting element (9) to move forward and to cause a shot.

5. The device as claimed in claim 4, characterized in that the hitting element (9) has a bottom having two separate steps behind each other, wherein the height of the forward step corresponds to the height of an upper shaft (16) provided on the rocking arm (15) that crosses the path of the first step, and the bottom of the hitting element (9) behind the first step is fitted to the upper surface of the slide (3) and slides thereon, and the second step is behind the rear end of the slide (3), and the slide (3) can move the hitting element (9) backward by the impact between the rear face and the second step.

6. The device as claimed in claim 1, characterized in that the second locking assembly is arranged slightly more rearward than the first locking assembly in order that after release of the second locking the first locking assembly can still lock the forward movement of the hitting element (9).

* * * * *